US006318024B1

(12) United States Patent
Krsnak et al.

(10) Patent No.: US 6,318,024 B1
(45) Date of Patent: Nov. 20, 2001

(54) OVERHEAD DOOR FAILURE PREVENTION SYSTEM AND METHOD OF USING SAME

(75) Inventors: Joseph J. Krsnak; James F. Lee, both of Bayside, NY (US)

(73) Assignee: Fallon Safety Systems, Inc., Flushing, NY (US)

( * ) Notice: Subject to any disclaimer, the term of this patent is extended or adjusted under 35 U.S.C. 154(b) by 0 days.

(21) Appl. No.: 09/458,879

(22) Filed: Dec. 10, 1999

(51) Int. Cl.[7] ..... E05F 11/00
(52) U.S. Cl. ..... 49/199; 49/177
(58) Field of Search ..... 377/15, 16, 17, 377/18, 19, 20, 22; 49/197, 199

(56) References Cited

U.S. PATENT DOCUMENTS 4,336,595 * 6/1982 Adams et al. ..... 364/508
4,872,124 * 10/1989 Shimizu et al. ..... 364/571.03
4,896,339 * 1/1990 Fukumoto ..... 377/19
4,965,817 * 10/1990 Angele ..... 377/19
5,107,439 * 4/1992 Clark ..... 364/484
5,185,709 * 2/1993 Johnson et al. ..... 364/558
5,293,774 * 3/1994 Ratherham ..... 73/116
5,831,343 * 11/1998 Nakazaki ..... 307/10.1
5,906,358 5/1999 Baziuk et al. .

* cited by examiner

*Primary Examiner*—Alvin Chin-Shue
*Assistant Examiner*—Curtis A. Cohen
(74) *Attorney, Agent, or Firm*—Morgan & Finnegan, LLP

(57) ABSTRACT

A system for servicing an overhead door having a spring counter balance mechanism, an operator and a directional control system. The servicing system includes a counter, information cards, and contact cards. The counter includes a counting device and a numeric display. The counting device records the number of full cycles of the springs used in the counter balance mechanism measured from the fully closed position of the door. The numeric display shows this number of full cycles. An inspector of the door compares this number to the cycle failure specification for the springs used in the counter balance mechanism listed on the information cards. If replacement or attention is required, the inspector uses the contact cards to inform the appropriate parties that the door is not functioning properly or that the springs require attention.

9 Claims, 2 Drawing Sheets

OVERHEAD DOOR FAILURE PREVENTION SYSTEM AND METHOD OF USING SAME

FIELD OF INVENTION

The present invention generally relates to a system for servicing an overhead door, and, more particularly, to a system for preventing failure of a spring counter balance system of an overhead door.

BACKGROUND AND OBJECT OF THE INVENTION

Garage doors of various sizes and designs operate in many buildings. The vast majority of these doors have some form of counter balance system to reduce the energy required to raise and lower the doors. For example, a spring counter balance system utilizes springs that are designed to operate for a standard number of elongation and contraction cycles. The number of cycles is a function of the design of the components, such as wire size and physical dimensions. In addition to the counter balance mechanism, the doors have motor powered operators or hoists that, through a mechanical connection to the door, open and close the door.

The opening and closing of the door generate wear and stress on all components of the door. Wear and stress occur during periods of use and during periods of inactivity. The springs of the counter balance system have service lives that are directly related to the number of times they have been repetitively elongated and contracted. This type of information is available to the public from the manufacturers of the spring.

After many repeated cycles of elongation and contraction, strain causes the material of the springs to fatigue and eventually fail. Upon failure, the springs break causing the ends or broken pieces to propel at substantial force in all directions. A release of energy in this manner causes damage to the door and the surroundings and can cause severe injury and fatalities.

Preventive maintenance, inspection and service of the counter balance system are crucial to the safe and reliable operation of the door.

In the past, service of the springs in the counter balance system has been scheduled based on time, i.e. the amount of time the system has been in place. However, this procedure provides service only to a small number of doors, does not take into account the cycle failure information available from the manufacturers of the springs, and cannot predict failure of the springs.

It is the object of the present invention to provide for maintenance of an overhead door system based on the number of full cycles of the springs.

It is another object of the present invention to count the number of full cycles of the springs in order to schedule planned maintenance of the overhead door system.

It is another object of the present invention to inform inspectors as to the number of full cycles the springs have gone through.

It is another object of the present invention to inform inspectors as to the specifications of the spring system.

It is another object of the present invention to inform the inspectors as to who to contact if the overhead door system is not functioning properly.

It is another object of the present invention to prevent catastrophic damage to people and property.

Objects and advantages of the present invention are set forth in part herein and part will be obvious here from, or may be learned in practice with the invention, the same being realized and attained by means of the instrumentalities and combinations pointed out in the appended claims.

The invention consists in the novel parts, constructions, arrangements, combinations, steps and improvements herein shown and described.

SUMMARY OF THE INVENTION

As set forth below, a need exists for a system and method of the same for servicing an overhead door system that counts full spring cycles and compares the number of cycles to the cycle failure specifications provided by the manufacturers of the springs. The system and method of the invention satisfies that problem.

One embodiment of the present invention features a counter, an component information card, and a contact card. Generally described, the counter includes a counting device and a numeric display. The counting device is connected to the directional control system of the overhead door. The directional control system controls the movement of the operator. The counting device, in combination with the operating limit switches of the operator, counts the number of full cycles of the springs used in the counter balance system of the overhead door from a fully closed position of the door. The numeric display shows an inspector the number of full cycles counted by the counting device. The component information card provides a manufacturer's cycle failure specification of the springs to be compared to the actual number of full cycles of the springs recorded by the numeric display. The contact card provides information if the door is not functioning properly or if the springs require replacement.

DETAILED DESCRIPTION OF THE PREFERRED EMBODIMENTS

Both the structure and operation of preferred embodiments of the present invention will now be described in greater detail with reference to the figures.

Typically, an overhead door slides on a pair of tracks mounted on either side of the door. The overhead door structure has rollers or the like to guide the door in the tracks. The overhead door slides between an substantially horizontal position (open) and a substantially vertical position (closed).

Most overhead door systems use springs as counter balance mechanisms to reduce the energy required to raise and lower the door. In addition to the counter balance mechanism, the doors use motor powered operators or hoists that, through a mechanical connection to the door, open and close the door.

The motor powered operator includes an operating limit switch. The operating limit switch is a mechanical point at which the door is fully opened or fully closed. The construction and operation of an operator having an operating limit switch are well known in the art.

The operator is controlled by a control system. Typically, the control system controls the direction and movement of the door by three buttons electrically connected to the operator. Each of the three buttons functions to open, close and stop the door, respectively.

Figure 1:
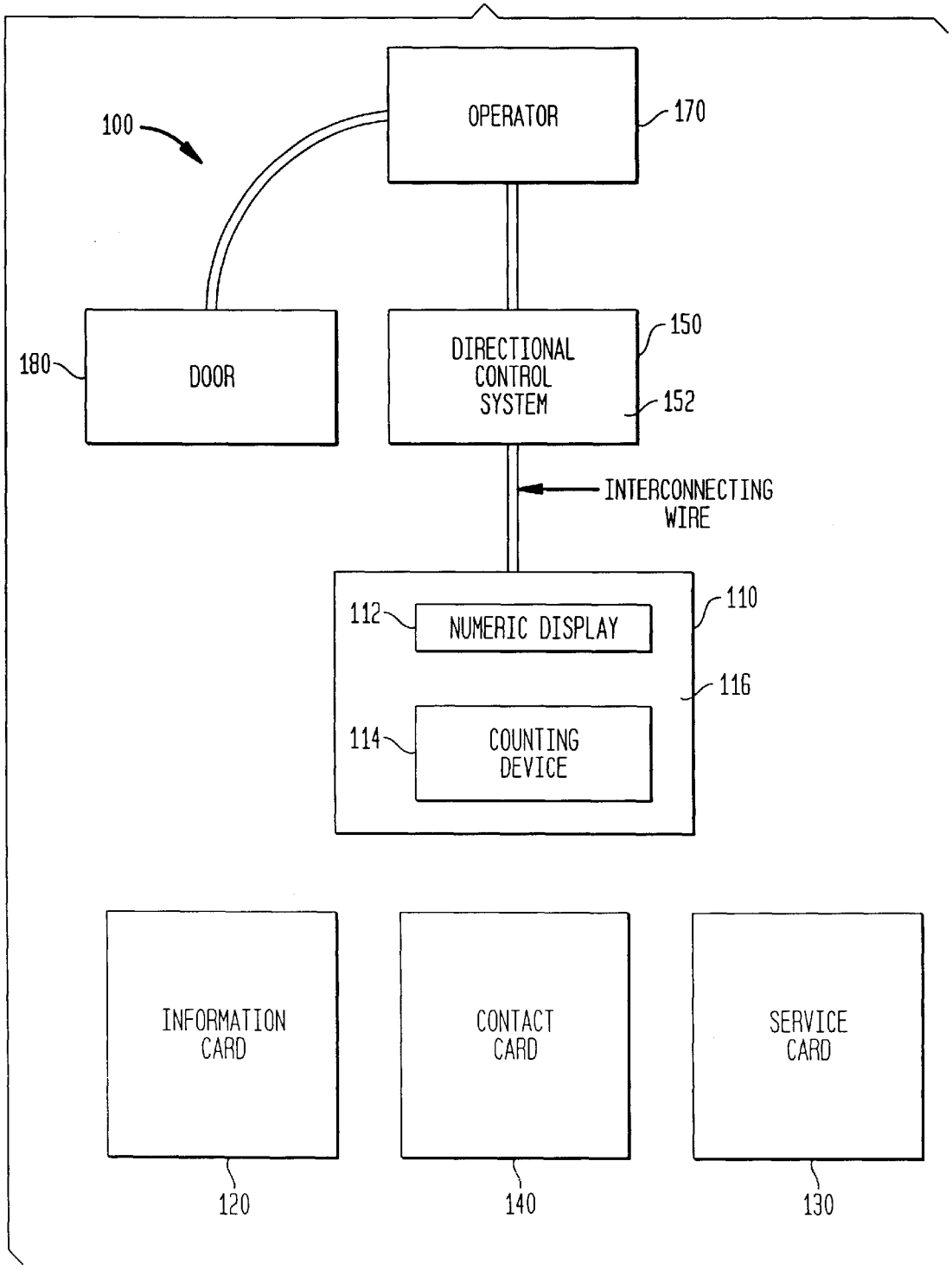
FIG. 1 illustrates a preferred embodiment of a system for maintaining an overhead door.
Figure 2:
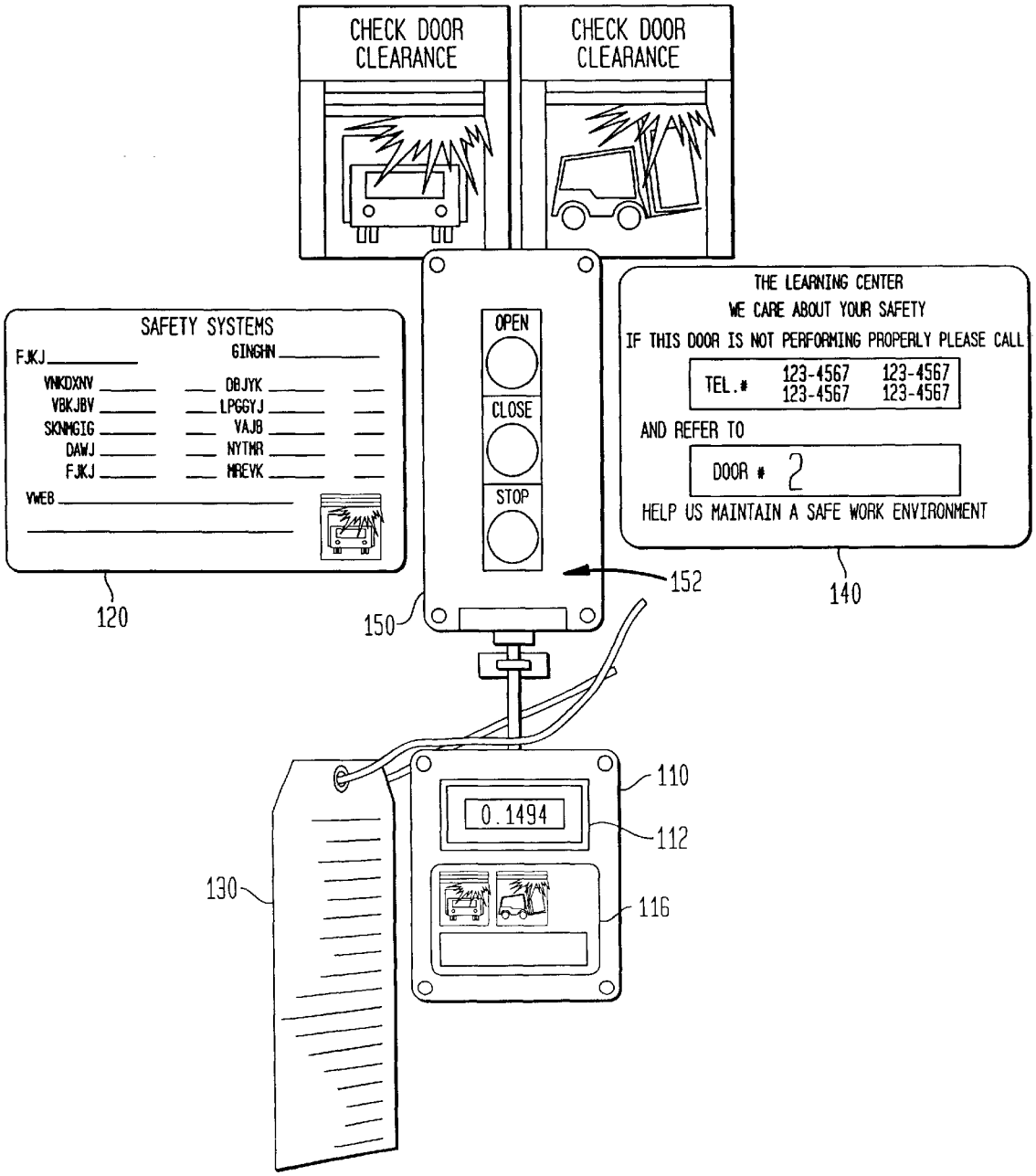
FIG. 2 illustrates an alternate arrangement of the preferred embodiment of the system for maintaining an overhead door of the invention.

Turning first to FIG. 1, there is illustrated a preferred embodiment of a system for maintaining an overhead door 100. In general, the overhead door serving system 100 includes a counter 110, a component information card 120, a service card 130, and a contact card 140.

The counter 110 includes a numeric display 112 and a counting device 114. The counter is connected to a directional control system 150 by the interconnecting cable 160. In an alternate embodiments, the counter 110 is connected to the operator 170 of the overhead door system. The counting device 112 and the numeric display 114 are contained within a housing 116 which is mounted relatively close to the directional control system 150. In other embodiments, the counting device 112 and the numeric display 114 are incorporated within the same housing 152 as the control system 150.

In the present embodiment, the numeric display 114 is digital. In other embodiments, the numeric display 114 is mechanical.

The counting device 112, which may be an electronic circuit or a microprocessor, records the number of full spring cycles. A full spring cycle occurs when strain is first removed and then applied again to the spring. In order for strain to be removed and applied to the springs, the spring must contract a reasonable distance and then elongate back to the original position.

A recordation or count by the counting device of a full spring cycle is most effective if taken from the point of maximum strain on The counter balance system. The maximum strain on the counter balance system occurs when the door 180 is fully closed, or when The springs art fully elongated. Therefore, the counting device records the reasonable movement of the door 180 from a location where the overhead door has stopped as a result of the activation of the operating limit switch of the operator 170 and then returned 10 this same point.

A full spring cycle registers on the numeric display 114 when the door has moved the reasonable distance from the operating limit stopped position and not from a stationary position caused by the use of the stop or hold button of the operator control system 150. In practice, an overhead door is opened partially to permit a person, a forklift or a truck to pass underneath. In this example, the door would be opened until the bottom of the door lifts approximately seven to ten feet from the ground at which point the stop button of the control system 150 is pressed. The door is then closed after the person, forklift or truck is clear.

With respect to the operation of the springs in this example, the door in the fully closed position is the point where the door has stopped as a result of the activation of the operating limit switch in the operator 170 and the springs are fully elongated. The springs relax or contract as the door opens and again elongate to their maximum elongation when the door is again closed. As the door closes, the operating limit switch of the operator 170 is activated. The counting device 112 considers the door that opens and then returns to its original closed position as one full cycle. The counter device 112 then adds one to the displayed number on the numeric display 114.

It should be understood that the counting device 112 is not limited to recording the movement of the door from a point where the door is closed or stopped as a result of an operating limit. The operating limit, for purposes of recording a fill spring cycle, can exist when the door is a reasonable distance from the opening position, or when the door is a distance from the fully opened or closed position. A full spring cycle would then exist when the door moves a reasonable distance from this predetermined position and then back to the predetermined position. A reasonable distance is a distance that puts a reasonable amount of strain on the springs, such as the height of a person, a forklift or a truck. The counting device 112 detects when the door has moved a reasonable distance from a predetermined position by using sensors, electric switches, or the like.

The counting device 112 does not count all the potential in-between stops before it returns to the predetermined position. Although the system 100 can be designed to have a plurality of predetermined positions, in practice, however, the overhead door is primarily opened a reasonable distance and then closed.

In order to assure that the springs of the counter balance mechanism used by an overhead door are properly and replaced, the component information card , the service card, the contact card and the warning stickers arm provided to be used in conjunction with the counter.

The component information card 120 includes information relating to the door, the counter, the springs and the mechanical door operator 170. The information relating to the springs includes the manufacturer, model number, type of springs, the manufacturer's cycle failure specification of the springs and the number of cycles the springs can withstand. The information relating to the operator 170 includes the manufacturer, model number, breaker number, and location of the power panel. The component information card 120 is positioned relatively close to the counter 110 for ease of access during periodic maintenance checks.

The service card 130 includes information relating to the servicing of the components of the overhead door. The service card includes the date, the cycle count and the inspector of the counter system 100. The service card also includes information on how often to check the components of the overhead door system and counter system 100. The service card 130 is positioned relatively close to the counter 110 for ease of access during periodic maintenance checks.

In another embodiment, the overhead door failure prevention system 100 includes a contact card or sticker 140 containing information on who to call if the door system is not functioning properly. The contact card 140 is positioned relatively close to the counter 116 for ease of access during periodic maintenance checks.

The counter 110 used in concert with the component information card 120, the service card 130 and the contact card 140 provide a direct method of use for a planned maintenance, service and inspection schedule for the overhead door system 100. When an inspection of the overhead door system is conducted, an inspector is able to compare the actual number of full cycles of the springs displayed by the numeric display 112 of the counter 110 with the manufacturer's cycle failure specification for the springs. If the number of full cycles is approaching a critical number, the inspector has quick access to the contact information on the contact card.

In alternate embodiments, the counting device 114 includes an alarm or other signal for alerting the inspector when the number of full cycles reaches a critical number. The critical number can be programmed into the counting device. The critical number is less than the cycle failure specification for the springs.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of the invention be determined by the appended claims and their equivalents.

What is claimed is:

1. A method for preventing spring failure in an overhead door system having at least one spring used as a counter balance system, said method comprising the steps of:

counting the number of full cycles of the at least one spring;

displaying the number of full cycles of the at least one spring;

periodically monitoring the displayed number of the full cycles;

comparing the displayed number to a cycle failure specification of the at least one spring; and servicing the overhead door system when said comparison shows that the displayed number reaches a critical number of full cycles, said critical number is less than the cycle failure specification of the at least one spring.

2. An overhead door system, said overhead door system comprising:

a door;

a door operator connected to the door;

a directional control system connected to the operator;

a spring counter balance mechanism controlled by the operator and connecting between the door and a remote location, said spring counter balance mechanism includes at least one spring; and a counter connected to the directional control system, said counter counts the number of full cycles of the at least one spring.

3. The system of claim 2, further comprising an information card located in proximity to the counter, said information card includes cycle failure specification for the at least one spring, said cycle failure specifications are compared to the number of full cycles displayed by the counter.

4. The system of claim 2, further comprising a contact card located in proximity to the counter, said contact card includes contact information if the system is not functioning properly.

5. The system of claim 2, wherein the counter includes a numeric display that displays the number of full cycles.

6. The system of claim 5, wherein the numeric display is digital.

7. The system of claim 5, wherein the numeric display is mechanical.

8. The system of claim 2, wherein a full cycle is counted when the door moves a distance from a closed position and then returns to the closed position.

9. The system of claim 2, wherein a full cycle is counted when the door moves a distance from a predetermined position and then returns to the predetermined position.

* * * * *